US009449752B2

(12) United States Patent
Taguchi et al.

(10) Patent No.: US 9,449,752 B2
(45) Date of Patent: Sep. 20, 2016

(54) DUST CORE, METHOD OF MANUFACTURING SAID DUST CORE, AND INDUCTANCE ELEMENT AND ROTARY ELECTRIC MACHINE INCLUDING SAID DUST CORE

(71) Applicant: Hitachi Metals, Ltd., Minato-ku, Tokyo (JP)

(72) Inventors: Masami Taguchi, Tokyo (JP); Shigeho Tanigawa, Tokyo (JP); Shin Noguchi, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 31 days.

(21) Appl. No.: 14/522,162

(22) Filed: Oct. 23, 2014

(65) Prior Publication Data

US 2015/0115766 A1 Apr. 30, 2015

(30) Foreign Application Priority Data

Oct. 25, 2013 (JP) ..... 2013-221938

(51) Int. Cl.
*H01F 27/02* (2006.01)
*H01F 27/255* (2006.01)
(Continued)

(52) U.S. Cl.
CPC ..... *H01F 27/255* (2013.01); *B22F 1/02* (2013.01); *B22F 5/106* (2013.01);
(Continued)

(58) Field of Classification Search
CPC ..... H01F 5/00; H01F 27/00–27/30
USPC ..... 336/65, 80, 200, 212, 233–234
See application file for complete search history.

(56) References Cited

U.S. PATENT DOCUMENTS 8,282,745 B2 * 10/2012 Tsuchiya ..... B82Y 25/00 148/121
8,685,179 B2 * 4/2014 Tsuchiya ..... C21D 6/00 148/304

(Continued)

FOREIGN PATENT DOCUMENTS

CN 1417264 A 5/2003
CN 101010756 A 8/2007

(Continued)

OTHER PUBLICATIONS

Chinese-language Office Action issued in counterpart Chinese Application No. 201410573689.7 dated Jun. 29, 2016 (five (5) pages).

(Continued)

*Primary Examiner* — Tuyen Nguyen
(74) *Attorney, Agent, or Firm* — Crowell & Moring LLP

(57) ABSTRACT

It is an objective of the invention to provide a dust core made of an Fe-based amorphous metal powder having excellent magnetic properties, in which the dust core has a higher-than-conventional density, excellent magnetic properties and a high mechanical strength. There is provided a dust core including a mixture powder compacted, the mixture powder including: an Fe-based amorphous metal powder having a crystallization temperature $T_x$ (unit: K), the Fe-based amorphous metal powder being plastically deformed, the plastically deformed metal Fe-based amorphous metal powder having a filling factor in the dust core higher than 80% and not higher than 99%; and a resin binder having a melting point $T_m$ (unit: K), in which the $T_x$ and $T_m$ satisfy a relationship of "$T_m/T_x \geq 0.70$".

7 Claims, 5 Drawing Sheets

(51) Int. Cl.

| | |
|---|---|
| ***B22F 1/02*** | (2006.01) |
| ***H01F 41/02*** | (2006.01) |
| ***H01F 1/153*** | (2006.01) |
| ***B22F 5/10*** | (2006.01) |

(52) U.S. Cl.
CPC ..... *H01F 1/15308* (2013.01); *H01F 27/02* (2013.01); *H01F 41/0246* (2013.01); *B22F 2998/10* (2013.01); *B22F 2999/00* (2013.01); *C22C 2200/02* (2013.01); *C22C 2202/02* (2013.01)

(56) References Cited

U.S. PATENT DOCUMENTS

2007/0256759 A1 11/2007 Matsukawa et al.
2008/0006352 A1* 1/2008 Koshiba ..... H01F 1/15308 148/561
2008/0142121 A1* 6/2008 Koshiba ..... B22F 5/006 148/100
2012/0286909 A1 11/2012 Ohwaki et al.

FOREIGN PATENT DOCUMENTS

| | | | |
|---|---|---|---|
| CN | 102693826 | A | 9/2012 |
| CN | 102779604 | A | 11/2012 |
| JP | 2002-184616 | A | 6/2002 |
| JP | 2009-120927 | A | 6/2009 |
| JP | 2010-141183 | A | 6/2010 |

OTHER PUBLICATIONS

English-language translation of Chinese Search Report issued in counterpart Chinese Application No. 201410573689.7 dated Jun. 29, 2016 (four (4) pages).

* cited by examiner

DUST CORE, METHOD OF MANUFACTURING SAID DUST CORE, AND INDUCTANCE ELEMENT AND ROTARY ELECTRIC MACHINE INCLUDING SAID DUST CORE

CLAIM OF PRIORITY

The present application claims priority from Japanese patent application serial no. 2013-221938 filed on Oct. 25, 2013, the content of which is hereby incorporated by reference into this application.

1. FIELD OF THE INVENTION

The present invention relates to dust cores, and particularly to a dust core made of an amorphous alloy powder and a method of manufacturing such a dust core. The invention also relates to an inductance element and a rotary electric machine including the dust core of the invention.

2. DESCRIPTION OF RELATED ART

With the growing consciousness of environmental protection and energy saving, echo products (ecologically friendly products) such as solar generation systems, hybrid vehicles and electric vehicles are coming into widespread use. In such eco products, DC-DC converters and inverters are used for high efficiency. In such DC-DC converters and inverters, inductance elements (such as electric reactors and choke coils) for voltage conversion or removal of undesirable current components (such as unnecessary AC components and noises) are used. In rotary electric machines such as motors, the magnetic properties of the stator and/or rotor of the rotary machine has a significant effect on the efficiency of the rotary machine.

For eco-products, component miniaturization is one of the essential requirements. In order to achieve smaller inductance elements, there is a growing demand for dust cores because they can be easily and freely formed into any desired compact shape. In order to achieve high efficiency converters or inverters, dust cores used in such devices need to have excellent magnetic properties and a high mechanical strength. Also, compact and high efficiency rotary electric machines can be achieved by using a dust core having excellent magnetic properties as the stator and/or rotor core of the rotary machine.

Dust cores are formed by applying an electrical insulation coating to particles of a soft magnetic metal powder and then pressing the coated particles. Examples of conventionally used soft magnetic metals are Fe (pure iron), Fe—Si (iron-silicon) based alloys, Fe—Si—Al (iron-silicon-aluminum) based alloys, and Fe—Ni (iron-nickel) based alloys. Amorphous metals (amorphous phase alloys) composed mainly of ferromagnetic elements such as Fe, Ni and Co (cobalt) are considered as a promising dust core material because of the excellent magnetic properties (such as high saturation flux density, high magnetic permeability and extremely low iron loss). Of these, Fe—Si—B (iron-silicon-boron) based amorphous metals have been drawing particular attention in recent years.

Amorphous metals are typically formed by super rapid quenching (such as single roller melt-quenching and super rapidly water-quenched atomization) of a molten alloy. Amorphous metals have advantages of high toughness, high corrosion resistance, desirable soft magnetism, etc., but also have a disadvantage in that they are very hard and difficult to plastically deform, and therefore have poor formability. Thus, there have been proposed various techniques for improving the formability of an amorphous metal powder in order to achieve a high performance dust core having a desired shape.

For example, JP 2010-141183 A discloses a method for forming a dust core including the steps of: mixing two or more different amorphous soft magnetic metal powders having different average particle sizes and a low melting point glass powder (a bismuth-based glass or a phosphoric acid-based glass) having a softening point lower than the crystallization temperatures of the amorphous soft magnetic metal powders; coating the above mixture powder with an electrical insulating binder resin; adding a lubricating resin to the coated mixture powder to obtain a final mixture powder; pressing the final mixture powder into a compact; and annealing the compact at a temperature lower than the crystallization temperatures of the amorphous soft magnetic metal powders in an air atmosphere. According to this JP 2010-141183 A, surfaces of the amorphous soft magnetic metal mixture powder particles are oxidized during the annealing, thereby increasing the adhesion between the low melting point glass powder particles and the amorphous soft magnetic metal mixture powder particles. Hence, a high mechanical strength dust core can be achieved even when the above-described final mixture powder is pressed at a low pressure and at room temperature.

As already described, a demand exists for smaller and higher performance inductance elements (such as electric reactors and choke coils). Accordingly, dust cores used in such electric reactors and choke coils need to have a higher density and a higher mechanical strength. One way of reducing the size of a dust core made of an amorphous metal powder is to improve the formability of the amorphous metal powder. One way of improving the formability of amorphous metal powders is to utilize an amorphous metal exhibiting a supercooled liquid state over a wide temperature range and exhibiting a distinct glass transition temperature. Hence, a variety of techniques utilizing such type of amorphous metal have been proposed.

For example, JP 2002-184616 A disclosed a dust core formed by: mixing a powder of a metallic glass alloy, a silicone elastomer binder and an aluminum stearate lubricant; and heating and press-forming the mixture powder.

The metallic glass alloy has, as a major phase, an amorphous phase containing an element X (one or both of Al and Ga), another element Q (one or more of P, C, Si and B) and Fe, and exhibits a supercooled state over a temperature range $\Delta T_x$ ($=T_x-T_g$) of 20 K or wider where $T_x$ is the crystallization onset temperature of the metallic glass alloy and $T_g$ is the glass transition temperature of the metallic glass alloy. According to this JP 2002-184616 A, during the heating and press-forming operation; the metallic glass alloy particles can easily slide on each other, thereby relaxing stresses and strains in the dust core and preventing any crystalline phase from precipitating in the dust core. Consequently, the resulting dust core has a high relative density, a high magnetic permeability and a low iron loss.

JP 2009-120927 A discloses an amorphous soft magnetic alloy having a composition (except for inevitable impurities) of the formula $(Fe_{1-a}M_a)_{100-w-x-y-z}Si_wB_xC_yL_z$ (where M is one or both of Co and Ni, L is one or more of Al, Cr and Mo, $0 \le a \le 0.3$, 4 atomic $\% \le w \le 10$ atomic %, 10 atomic $\% \le x \le 18$ atomic %, 1 atomic $\% \le y \le 7$ atomic %, 0.3 atomic $\% \le z \le 5$ atomic %); having a temperature difference $\Delta T_x$ ($=T_x-T_g$) of 20° C. or more (where $T_x$ is the crystallization onset temperature of the amorphous soft magnetic alloy and $T_g$ is the glass transition temperature of the alloy); and having a saturation flux density of 1.2 T or higher. This JP 2009-120927 A also discloses a dust core formed by mixing the above amorphous soft magnetic alloy powder and a binder, and molding (or pressing) the mixture powder. According to this JP 2009-120927 A, the disclosed soft magnetic alloy can be relatively easily caused to become amorphous, and therefore can be formed into an amorphous alloy even using a cooling rate as slow as about $10^{3}$° C./sec. Also, the amorphous soft magnetic alloy has a highly uniform amorphous structure without any magnetic anisotropy, and as a result has excellent soft magnetic properties. In addition, the dust core made of the amorphous soft magnetic alloy powder can be formed into small sizes.

As already described, amorphous metals are very hard and therefore can hardly be plastically deformed at room temperature. Hence, conventionally, an extremely high pressure (e.g., 1500 to 2000 MPa) has been needed to increase the density of a pressed powder product. However, in order to use such a high pressure (compressive stress), a costly press machine and mold are required, thus leading to an overall manufacturing cost increase. Furthermore, an amorphous metal is extremely difficult to plastically deform even by such a large pressure at room temperature. As a result, a relative density of the resulting pressed compact (a filling factor of the amorphous metal in the resulting pressed compact) is limited to about 80% at the highest.

The above-mentioned JP 2010-141183 A describes that a high mechanical strength dust core can be obtained even when press-formed at a pressure as low as 1300 MPa at room temperature. However, a pressure of 1300 MPa seems to be still too high to suppress the manufacturing cost. Also, although the dust core of the JP 2010-141183 A is press-formed at a relatively high pressure, it seems not to have a sufficiently high density so as to achieve a high mechanical strength. A dust core having an insufficient mechanical strength may potentially be damaged during the winding process of an inductance element using the dust core.

The dust cores disclosed in the above-mentioned JP 2002-184616 A and JP 2009-120927 A are obtained by warm/hot working a metallic glass powder that can be easily deformed and densified. However, metallic glasses are generally inferior to Fe—Si—B based amorphous metals in terms of important soft magnetic properties (such as high magnetic permeability, low coercive force and high flux density). This is because a metallic glass contains large amounts of non-ferromagnetic elements other than ferromagnetic elements in order to achieve a supercooled state over a wide temperature range. Furthermore, even if a high density compact can be made from a powder of metallic glass particles, the compact may have a problem in that the particles in the compact may not be sufficiently electrically insulated from each other or the compact may be damaged when released from a mold. A possible cause of the latter problem is that because the supercooled state of metallic glasses occurs at high temperatures more than 400° C., and therefore lubrication between the mold and the compact can be insufficient.

With the accelerating need for higher efficiency, higher output, smaller size and lower cost eco-products, the requirements for components for such eco-products have been becoming more and more stringent than ever before. However, conventional dust cores are becoming unable to meet such increasingly stringent requirements.

SUMMARY OF THE INVENTION

In order to satisfy the above-described requirements, it is an objective of the present invention to provide a dust core made of an Fe-based amorphous metal powder having excellent magnetic properties, in which the dust core has a higher-than-conventional density (e.g., a filling factor of the amorphous metal higher than 80%), excellent magnetic properties and a high mechanical strength. Another objective is to provide a method of manufacturing such a dust core of the invention at low cost. Still another objective is to provide, by using the dust core of the invention, an inductance element and a rotary electric machine that satisfy requirements for eco-product components.

(I) According to one aspect of the present invention, there is provided a dust core including a mixture powder compacted, the mixture powder including:

an Fe-based amorphous metal powder having a crystallization temperature $T_x$ (unit: K), the Fe-based amorphous metal powder being plastically deformed, the plastically deformed metal Fe-based amorphous metal powder having a filling factor in the dust core higher than 80% and not higher than 99k; and a resin binder having a melting point T (unit: K), in which the $T_x$ and $T_m$ satisfy a relationship of "$T_m/T_x \geq 0.70$".

In the above aspect (I) of the invention, the following modifications and changes can be made.

i) The crystallization temperature $T_x$ of the Fe-based amorphous metal powder is 823 K or lower, and the melting point $T_m$ of the resin binder is 533 K or higher.

ii) The Fe-based amorphous metal powder is a powder of an Fe—Si—B based amorphous metal, and the resin binder is one of polyether ether ketone, poly-phenylene sulfide and Polyamide 66.

(II) According to another aspect of the present invention, there is provided a method of manufacturing a dust core, the dust core including a mixture powder compacted, the mixture powder including:

an Fe-based amorphous metal powder having a crystallization temperature $T_x$ (unit: K), the Fe-based amorphous metal powder being plastically deformed, the plastically deformed Fe-based amorphous metal powder having a filling factor in the dust core higher than 80% and not higher than 99%; and a resin binder having a melting point $T_m$ (unit: K), the $T_x$ and $T_m$ satisfying a relationship of "$T_m/T_x \geq 0.70$", the method including:

a resin binder coating step of coating the Fe-based amorphous metal powder with the resin binder;

a warm-pressing step of pressing the Fe-based amorphous metal powder coated with the resin binder at a temperature T ($0.75\ T_x < T \leq 0.95\ T_x$) and at a pressure P (500 MPa$\leq$P$\leq$1000 MPa); and a strain relaxation heat treatment step of relaxing strains accumulated in the Fe-based amorphous metal powder.

In the above aspect (II) of the invention, the following modifications and changes can be made.

iii) The Fe-based amorphous metal powder is a powder of an Fe—Si—B based amorphous metal, and the resin binder is one of polyether ether ketone, poly-phenylene sulfide and Polyamide 66.

iv) The warm-pressing step and/or the strain relaxation heat treatment step are performed by microwave heating.

(III) According to still another aspect of the present invention, there is provided an inductance element including a dust core, in which at least one part of the dust core is the dust core according to the present invention described above.

In the above aspect (III) of the invention, the following modifications and changes can be made.

v) The inductance element is an electric reactor or a choke coil.

(IV) According to still another aspect of the present invention, there is provided a rotary electric machine including a dust core, in which at least one part of the dust core is the dust core according to the present invention described above.

In the above aspect (IV) of the invention, the following modifications and changes can be made.

vi) The dust core is a stator core and/or a rotor core.

Advantages of the Invention

According to the present invention, it is possible to provide a dust core formed by pressing and plastically deforming particles of an Fe-based amorphous metal having excellent magnetic properties while maintaining electrical insulation among the particles, in which the dust core has a higher-than-conventional density (e.g., a filling factor of the amorphous metal higher than 80%), excellent magnetic properties and a high mechanical strength. Also possible is to provide a method of manufacturing such a dust core of the invention at low cost. Further possible is to provide, by using the dust core of the invention, an inductance element and a rotary electric machine that satisfy requirements for eco-product components.

DETAILED DESCRIPTION OF THE PREFERRED EMBODIMENTS

Primary Motivation for the Present Invention

Figure 1:
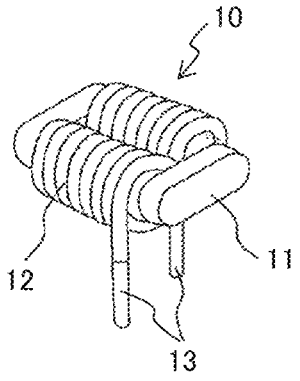
FIG. 1 is a schematic illustration showing a perspective view of an example of induction elements (a choke coil)

The maximum filling factor (packing density) of different diameter undeformed perfect spheres are theoretically about 78% even if the diameter distribution is optimized to maximize the filling factor. A theoretically promising way to increase the filling factor (relative density) of the amorphous metal particles in a dust core is to plastically deform the amorphous metal particles.

It may be possible that amorphous metal particles can be plastically deformed by pressing in a temperature range slightly below the crystallization temperature $T_x$. For example, in the above-mentioned JP 2002-184616 A, a mixture of a metallic glass alloy powder (spherical particles), a binder and a lubricant is heated to a prespecified temperature and then press-formed. According to this JP 2002-184616 A, the density of a dust core can, by adding a lubricant to the component materials of the dust core, be increased compared to dust cores fabricated without using any lubricant.

However, the density of the metallic glass alloy dust core achieved by this JP 2002-184616 A can probably be estimated to correspond to less than 80% on the filling factor (relative density) basis. Therefore, the metallic glass alloy particles in the dust core are probably not plastically deformed (because if the particles are sufficiently plastically deformed, the relative density of the dust core would be expected to be far higher than the theoretical packing density of perfect spheres). It seems from the result of this JP 2002-184616 A that it has been conventionally difficult to plastically deform amorphous metal particles used for dust cores.

Amorphous metal particles in dust cores need to be electrically insulated from each other in order to reduce eddy current loss. So, amorphous metal particles in dust cores are coated with lubricating and electrical insulating layers prior to press-forming.

Generally, resin binders (e.g., epoxy resin, phenolic resin and acrylic resin), even when used in thin layers, have excellent lubricating and electrical insulating properties, and hence have an advantage in that resin binder coatings occupy only a small volume in a dust core and therefore contribute to a reduced filling factor of the resin binder coatings. However, resin binders have a disadvantage in that they have a relatively low thermal resistance, and therefore cannot withstand sufficiently high temperature warm-forming processes so as to plastically deform amorphous metal particles for dust cores.

Inorganic binders (such as oxide powders) have an advantage because they have a high thermal resistance and therefore warm pressing can be performed at sufficiently high temperatures. However, inorganic binders also have a disadvantage in that they need a relatively large thickness in order to achieve sufficient lubrication and electrical insulation, and therefore cannot provide high filling factors of the amorphous metal particles. Thus, there has not heretofore been any solution that satisfies all of the above requirements (high filling factor, good lubrication and high electrical insulation).

In order to solve the above problem, the present inventors have actively tried to find some method of forming a dust core from an Fe-based amorphous metal powder having excellent magnetic properties, in which the dust core has a higher density than conventional dust cores and has sufficient electrical insulation among the metal powder particles after pressing of the metal powder. As a result of the efforts, the inventors have finally found that the above objective can be achieved by selecting, as the component materials of a dust core, an Fe-based amorphous metal and a resin binder in such a way that the crystallization temperature $T_x$ (unit: K) of the amorphous metal and the melting point $T_m$ (unit: K) of the binder satisfy a relationship of "$T_m/T_x \geq 0.70$", and optimizing a warm pressing temperature of the component materials of the dust core. The present invention is based on this new technological knowledge.

As describe above, the dust core of the invention is characterized in that the dust core is made of a compacted mixture powder mainly containing a powder of Fe-based amorphous metal particles and a resin binder; the crystallization temperature $T_x$ (K) of the amorphous metal and the melting point $T_m$ (K) of the binder satisfy a relationship of "$T_m/T_x \geq 0.70$"; the amorphous metal particles are plastically deformed; and the filling factor of the metal particles in the dust core is higher than 80% and not higher than 99%. If the amorphous metal particles before compaction are assumed to be almost perfectly spherical, the fact that the amorphous metal particles after compaction have a filing factor higher than 80% probably indicates that at least part of each particle is plastically deformed. According to the invention, the filling factor is preferably 82% or higher and more preferably 85% or higher in order to achieve a dust core having excellent magnetic properties and a high mechanical strength.

The embodiments of the invention will be described below in detail according to the manufacturing steps. The invention is not limited to the specific embodiments described below, but various combinations and modifications are possible without departing from the spirit and scope of the invention.

(Dust Core and Manufacture Method Thereof)

As described above, a dust core (compacted powder magnetic core) of the invention is made of an Fe-based amorphous metal and a resin binder where the crystallization temperature $T_x$ (K) of the amorphous metal and the melting point T, (K) of the resin binder satisfy a relationship of "$T_m/T_x \geq 0.70$". The term "amorphous metal", as used herein and in the appended claims, includes amorphous materials called metallic glasses.

The crystallization temperature $T_x$ of the Fe-based amorphous metal is typically about from 723 to 1023 K (450 to 750° C.), and its softening point, around which plastic working is possible, is typically about from 573 to 873 K (300 to 600° C.). There is some relationship between the softening point of the Fe-based amorphous metal and its crystallization temperature $T_x$. For most Fe-based amorphous metals, the softening point is 100 to 130 K lower than the crystallization temperature $T_x$. That is, an Fe-based amorphous metal with a lower crystallization temperature $T_x$ can be plastically processed at lower temperatures. For example, an Fe-based amorphous metal with a crystallization temperature $T_x$ of 723 K can be plastically worked at low temperatures of about 593 to 623 K; an Fe-based amorphous metal with a $T_x$ of 1023 K can be plastically worked at low temperatures of about 893 to 923 K.

When the $T_m/T_x \geq 0.70$, the particles of the Fe-based amorphous metal can be plastically deformed without thermally degrading the resin binder at a temperature for forming the dust core. Thus, a dust core with excellent magnetic properties and a high mechanical strength can be obtained. In contrast, when the $T_m/T_x < 0.70$, it is difficult to achieve both a good plastic deformability of the particles of the Fe-based amorphous metal and a high thermal resistance of the resin binder. Judging from the melting point of the resin binder, the upper limit of the $T_m/T_x$ is probably about 0.85.

The resin binder provides electrical insulation among the amorphous metal particles. When the resin binder thermally degrades, the eddy current loss generated in the dust core significantly increases. Therefore, the Fe-based amorphous metal preferably has a lowest possible crystallization temperature $T_x$ so that the dust core can be plastically deformed without causing thermal degradation of the resin binder. For example, the crystallization temperature $T_x$ of the Fe-based amorphous metal is preferably 823 K or lower, and more preferably 743 K or lower. Among such low $T_x$ Fe-based amorphous metals, Fe—Si—B based ones are particularly preferable because of the high saturation flux density, high magnetic permeability and extremely low iron loss. For example, Fe—Si—B—Cr—C, Fe—Si—B—Co and Fe—Si—B—Cu—Nb based amorphous metals can be used. More specifically, milled powders of 2605HB1 (Metglas, Inc., $T_x$=739 K), atomized powders having a 2605HB1-like composition, milled powders of 2605SA1 (Metglas, Inc., $T_x$=763 K), atomized powders having a 2605SA1-like composition, and KUAMET (a registered trademark of Epson Atmix Corporation, $T_x$=813 K) can be suitably used.

The particle size of the Fe-based amorphous metal powder is not particularly limited, but its average particle size is preferably from 10 to 200 μm for the dust core.

The resin binder preferably has a high thermal resistance in order to prevent thermal degradation at temperatures for forming the dust core. Suitable examples of such highly thermal resistant resin binders are polyether ether ketone (PEEK, $T_m$=613 K), poly-phenylene sulfide (PPS, $T_m$=613 K), and Polyamide 66 (PA66, $T_m$=538 K). PEEK is particularly preferable because of the high thermal resistance, excellent sliding properties and high mechanical strength.

The dust core is manufactured by first mixing the Fe-based amorphous metal particles and the resin binder, and then coating surfaces of the Fe-based amorphous metal particles with the resin binder (resin binder coating step). Volume mixing ratio of the Fe-based amorphous metal particles to the resin binder is preferably from 85:15 to 99:1. When the volume percentage of the resin binder is more than 15 volume %, the Fe-based amorphous metal particles may potentially not be sufficiently plastically deformed and consequently the resulting dust core may have a poor density and poor magnetic properties. When the volume percentage of the resin binder is less than 1 volume %, the amount of resin binder is too small to achieve sufficient electrical insulation among the amorphous metal particles.

There is no particular limitation on the mixing and coating methods, but any known method (e.g., mechanical mixing) may be used.

Next, the Fe-based amorphous metal particles coated with the resin binder are subjected to a warm forming process at a certain temperature and pressure using a hot press machine to form a compact (warm forming step). The warm forming of the invention includes the sequential steps of pressurizing, heating, maintaining and simultaneously depressurizing and cooling.

The warm forming temperature T is preferably "$0.75T_x < T \leq 0.95T_x$". As already described, it is expected that amorphous metals can be plastically deformed by applying a force at a temperature slightly below the crystallization temperature $T_x$. In order to investigate this possibility, a high temperature tensile test was performed on the aforementioned 2605HB1 and 2605SA1.

The high temperature tensile test was performed as follows: First, for 2605HB1 and 2605SA1, an amorphous metal ribbon (thickness of 0.025 mm) was prepared. Then, dumbbell-shaped tensile test samples (parallel portion of 50 mm×12.5 mm×0.025 mm) were cut out from each ribbon by electro-discharge machining. After that, each test sample was placed on a universal tester (Shimadzu Corporation) in an air atmosphere. Next, the sample was heated to a target temperature T (room temperature to 693 K), and was then stretched (crosshead speed of 5 mm/min) within 5 min. after the target temperature was reached.

The result was that for both of 2605HB1 and 2605SA1, test samples heated to above about $0.75T_x$ were plastically deformed by the stretching. This test result shows that Fe-based amorphous metal particles are probably difficult to plastically deform at forming temperatures T not higher than $0.75T_x$ ($T \leq 0.75T_x$). On the other hand, when $0.95T_x < T$, some of the Fe-based amorphous metal particles may potentially start to crystallize. Also, the warm-forming temperature is preferably not lower than a temperature slightly below the melting point $T_m$ of the resin binder (e.g., $T_m$−10 K) and lower than the thermal decomposition temperature of the binder.

There is no particular limitation on the heating method during the warm forming, but any known heating method may be used. For example, microwave heating (frequency, 300 MHz to 300 GHz) is preferable. When Fe-based amorphous metal particles are plastically deformed by the warm forming, mainly the surface regions of the particles plastically deform. The microwave heating can heat only the surface regions of all the amorphous metal particles simultaneously. Therefore, the heating time can be shortened, thus leading to manufacturing cost reduction. Also, compared with radiation heatings, excessive heating of the resin binder (excessive heat input into the binder) can be prevented.

Warm forming pressure is preferably from 500 to 1000 MPa. When the forming pressure is less than 500 MPa, the Fe-based amorphous metal particles cannot be sufficiently plastically deformed. In order to use a high forming pressure more than 1000 MPa, a costly press machine and mold are required.

The warm forming is preferably performed in a non-oxidizing (practically very little-oxidizing) atmosphere such as nitrogen and argon.

After the warm forming, a strain relaxation heat treatment is performed in order to relax strains accumulated in the Fe-based amorphous metal particles. Again, there is no particular limitation on the heating method used at this heat treatment step, but any known heating method may be used. Similarly to the above-mentioned warm forming process step, microwave heating is preferable. In addition, there is no particular limitation on the strain relaxation heat treatment temperature and time so long as the Fe-based amorphous metal particles do not crystallize. The strain relaxation heat treatment may be performed in a non-oxidizing atmosphere or in an air atmosphere.

Thus, the dust core of the invention can be obtained by following the above manufacturing steps.

(Induction Element and Rotary Electric Machine)

Figure 2:
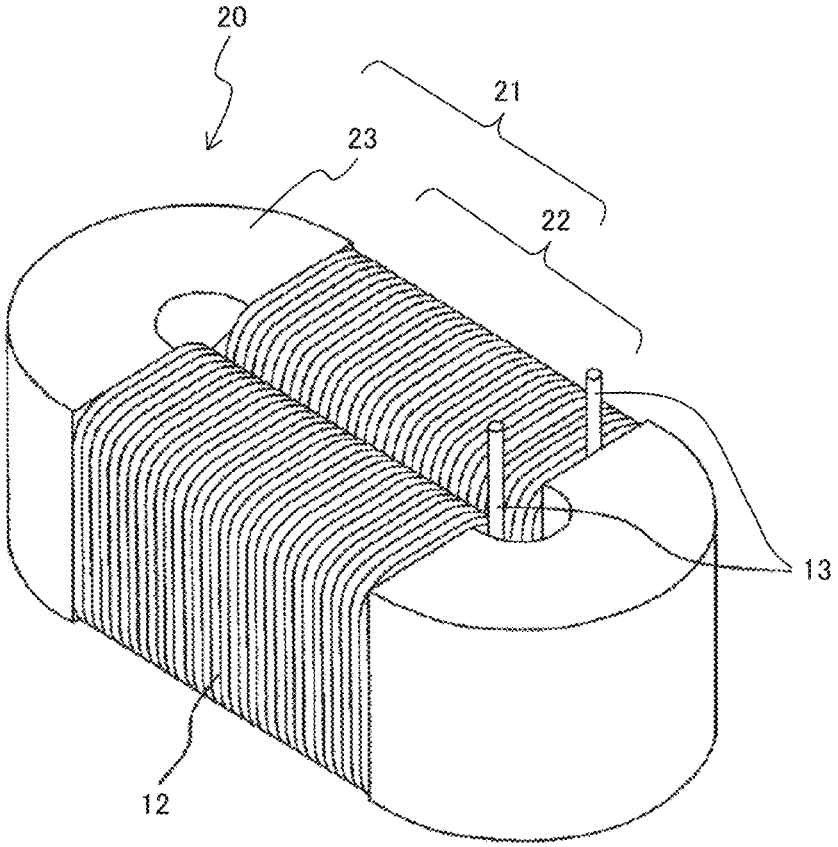
FIG. 2 is a schematic illustration showing a perspective view of another example of induction elements (an electric reactor)

Using the dust core of the invention, smaller and higher efficiency induction elements and rotary electric machines than conventional ones can be provided. FIG. 1 is a schematic illustration showing a perspective view of an example of induction elements (a choke coil). FIG. 2 is a schematic illustration showing a perspective view of another example of induction elements (an electric reactor).

As illustrated in FIG. 1, a choke coil 10 according to the invention includes a dust core 11 of the invention; an electric wire 12 wound around the dust core 11; and terminals 13 at the both ends of the wire 12. The dust core 11 is of continuous (closed) ring shape (e.g., racetrack shape) and its cross section is rectangle or round. The choke coil 10 is used, for example, as booster circuits in home appliances, etc.

As illustrated in FIG. 2, an electric reactor 20 according to the invention includes a dust core 21 of the invention; an electric wire 12 wound around the dust core 21; and terminals 13 at the both ends of the wire 12. The dust core 21 is of ring shape, which is formed by connecting two straight members 22 and two U-shaped members 23. The members 22 and 23 may be connected using an adhesive such as a resin adhesive, or a mechanical means such as a band. The electric reactor 20 is used, for example, as booster circuits in hybrid vehicles and photovoltaic power generating systems.

As the dust core 21, the dust core of the invention may be used to form all of the members (the straight members 22 and U-shaped members 23). Alternatively, in order to adjust the overall magnetic permeability of the electric reactor 20, the invention's dust core may be used to form the straight members 22, while a conventional dust core (such as Fe—Si and Fe—Al—Si based dust cores) may be used to form the U-shaped members 23. That is, the invention's induction element may entirely or partially include the invention's dust core.

In rotary electric machines (such as motors), the magnetic properties of the iron cores of the stator and rotor have a significant effect on the efficiency of the rotary electric machine. The dust core of the invention can be easily and freely shaped; therefore a desired-shape stator or rotor core having excellent magnetic properties and a high mechanical strength can be achieved. Hence, smaller and higher-efficiency rotary electric machines can be provided using the dust core of the invention.

EXAMPLES

The invention will be described below in more detail by way of specific examples. However, these examples are for illustrative purpose only and are in no way intended to limit the invention.

Experiment 1

Fabrication of Dust Core

First, a water-atomized Fe—Si—B based amorphous metal powder (crystallization temperature $T_x$=739 K) having a composition similar to a 2605HB1 amorphous ribbon (Metglas Inc.) was prepared. Then, the amorphous metal powder was sieved to obtain particles of 100 μm or smaller in size. Next, a resin binder of polyether ether ketone (PEEK, melting point $T_m$=613 K) was added to the amorphous metal powder in such a way that the concentration of the binder was 10 volume %. Then, the mixture was kneaded (compounded) using a Labo Plastomill (Brabender Co., Ltd.; W50EHT). After that, because the kneaded powder particles were agglomerated by the kneading, the kneaded powder was crushed in a mortar to obtain particles of 0.5 mm or smaller in average size.

Figure 3A:
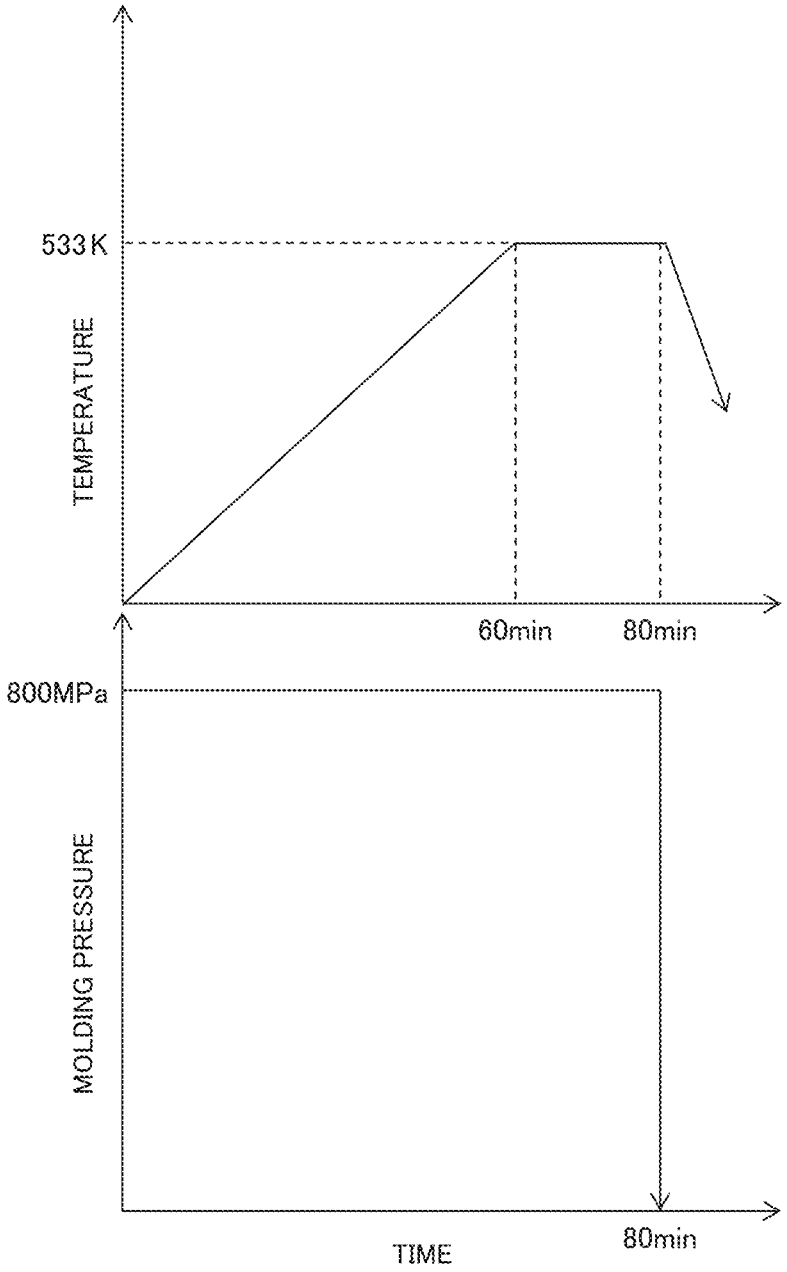
FIG. 3A is a time-temperature chart of a warm molding operation.
Figure 3B:
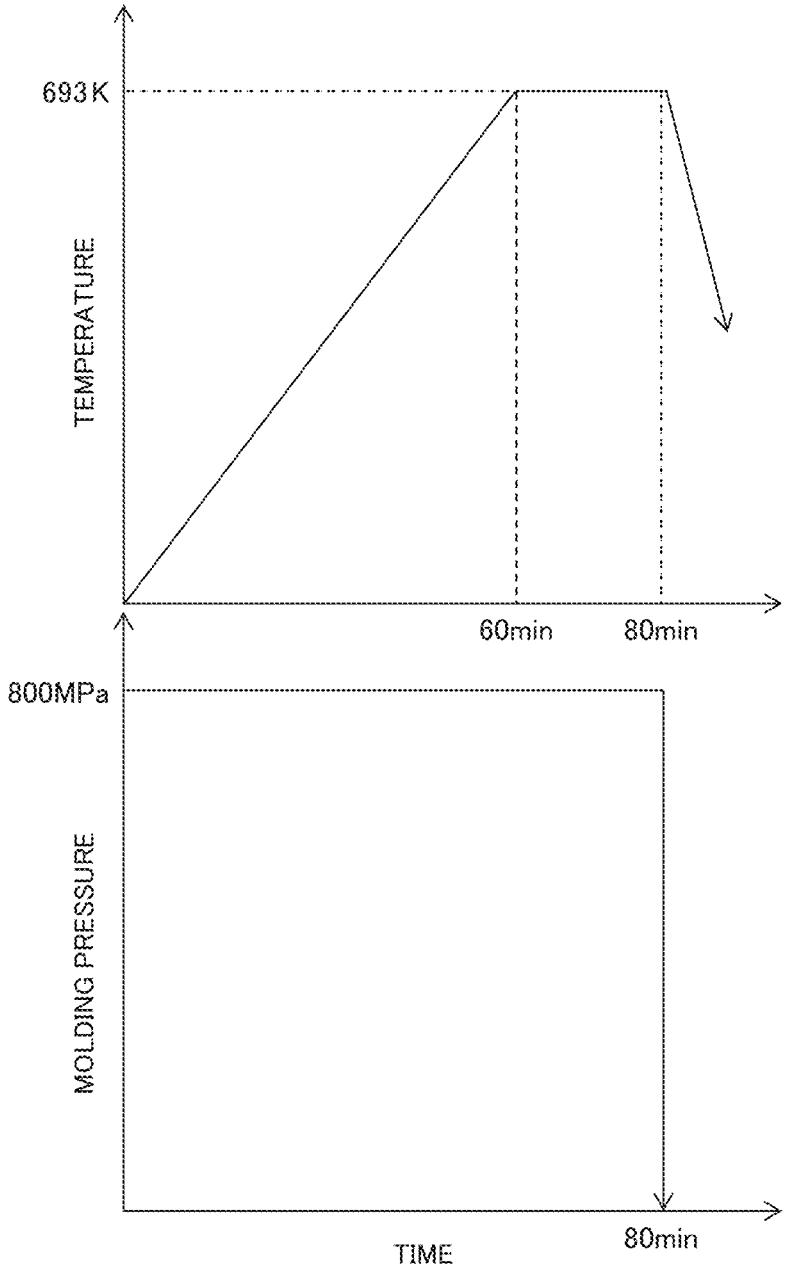
FIG. 3B is a time-pressure chart of the warm molding operation.

Finally, 1.5 g of the crushed Fe—Si—B based amorphous metal powder was poured into a super hard metal mold (outer diameter of 13 mm; inner diameter of 8 mm) and was then warm molded into a round pellet using a hot pressing machine (TOKYO VACUUM GP-2300). FIG. 3A is a time-temperature chart of a warm molding operation. FIG. 3B is a time-pressure chart of the warm molding operation. As shown in FIGS. 3A and 3B, the amorphous metal powder in the mold was first quickly pressurized to 800 MPa without heating, then heated to a target temperature in 60 min, maintained at this temperature for 20 min, and then depressurized quickly. The warm-molding was conducted at various target temperatures from 533 to 693 K. The atmosphere was nitrogen gas. In this way, there were obtained various Fe—Si—B based amorphous metal powder annular pellets (outer diameter of 13 mm; inner diameter of 8 mm; thickness of 3 mm) that were molded at different temperatures.

Finally, each of the thus obtained round pellets (outer diameter of 13 mm; inner diameter of 8 mm; thickness of 3 mm) was subjected to a strain relaxation heat treatment (maintaining at 673 K for 1 hour in air) to obtain a dust core sample of the invention. A commercially available dust core made of an Fe based amorphous metal was used as a reference sample.

(Property Evaluation of Dust Core)

(1) Filling Factor Evaluation of Fe based Amorphous Metal

The filling factor of the Fe based amorphous metal in each of the thus fabricated dust cores was estimated by observing a sectional structure of the dust core under a scanning electron microscope SEM (S-2380N available from Hitachi, Ltd.) The filling factor of the Fe based amorphous metal in each dust core sample was estimated by the following equation:

(Filling factor of Fe based amorphous metal (%))= (Area occupied by Fe based amorphous metal within selected field of view of SEM)/(Area of selected field of view of SEM)×100.

Herein, "area of field of view of microscope (such as SEM and optical microscope)" means "the total area of the field of view of the microscope". Therefore, in the above equation, "area of selected field of view of SEM" means "the total area of the selected field of view of the SEM". In this experiment, the field of view of the SEM is preferably so selected as to contain about 100 to 300 Fe-based amorphous metal particles (the corresponding magnification is about 200 to 500×). "Area occupied by Fe based amorphous metal within selected field of view of SEM" can be obtained by, for example, image analysis of the SEM image. The result is shown in Table 1.

Figure 4A:
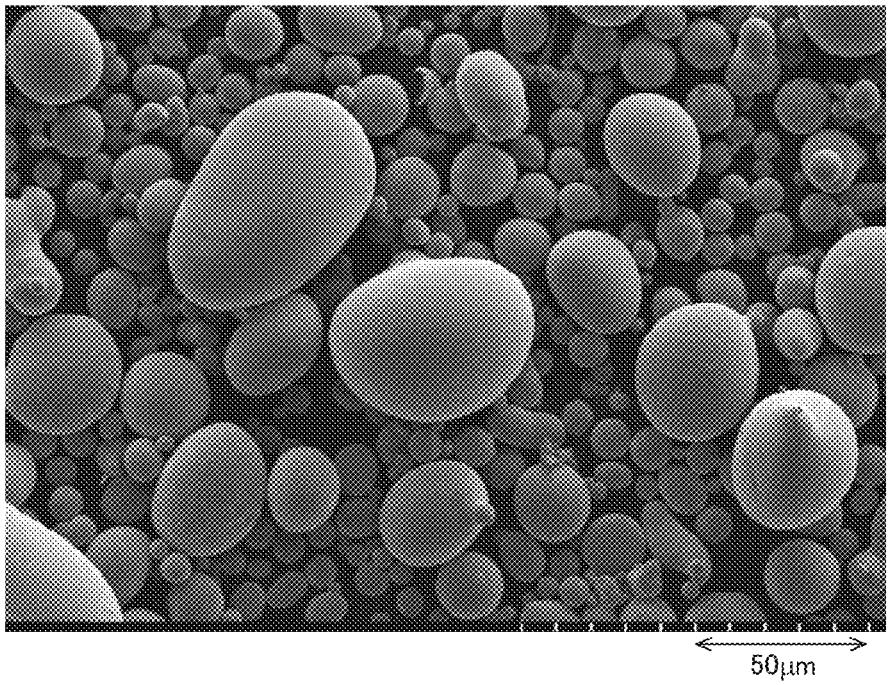
FIG. 4A is an SEM image showing the Fe based amorphous metal powder used in Experiment 1 (before the warm molding)
Figure 4B:
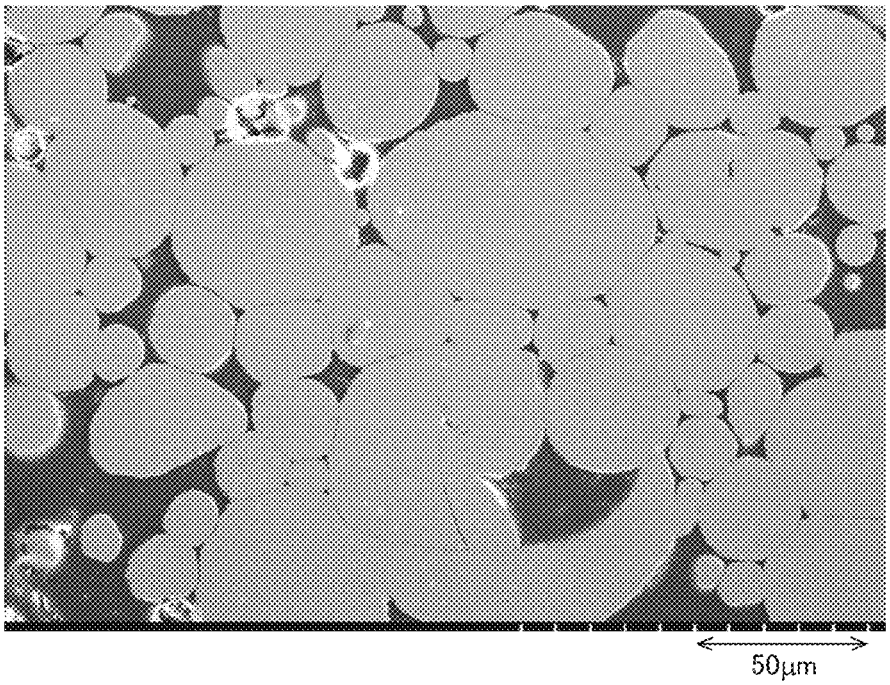
FIG. 4B is an SEM image showing an example of the sectional structure of a dust core sample.

FIG. 4A is an SEM image showing the Fe based amorphous metal powder used in Experiment 1 (before the warm molding). FIG. 4B is an SEM image showing an example of the sectional structure of a dust core sample. As shown in FIG. 4A, the Fe based amorphous metal powder particles before the warm molding each have sphere-like shapes (which are not limited to perfect spheres but include imperfect ellipsoidal shapes, predominantly concave shapes, etc.) By contrast, the SEM image for an invention's dust core having a filling factor 85% or higher as shown in FIG. 4B clearly shows that, at some boundaries between adjacent particles, the particle surfaces at both sides of the boundary are flattened and become parallel to each other by plastic deformation of the originally sphere-like particles with the resin binder of a generally uniform width being sandwiched therebetween. However, even the invention's dust core still has some voids.

The result of the SEM observation of whether the amorphous metal particles in dust core samples are plastically deformed is also shown in Table 1. In Table 1, a sample that exhibits plastic deformation and has a filling factor higher than 80% is indicated by "observed"; a sample that does not exhibit any plastic deformation is indicated by "not observed".

(2) Mechanical Strength Evaluation

The thus fabricated dust core samples were evaluated for the mechanical strength. In this experiment, the radial crushing strength was measured as a representative of the mechanical strength. The radial crushing strength was measured according to "Sintered metal bearing-Determination of radial crushing strength" (JIS Z 2507). The radial crushing strength is given by an equation of "$K=F(D-e)/L\cdot e^2$)", where K (unit: MPa) is the radial crushing strength, F (unit: N) is the maximum load at crush, L (unit: mm) is the thickness of the annular pellet, D (unit: mm) is the outer diameter of the annular pellet and e (unit: mm) is the difference between the outer and inner diameters of the annular pellet. The result is also shown in Table 1.

(3) Magnetic Property Evaluation

The thus fabricated dust core samples were evaluated for the magnetic properties. In this experiment, the flux density generated by an external magnetic field was measured as a representative of the magnetic properties. Specifically, the flux density $B_{100}$ (unit: T) in a magnetic field of 10000 Oe (approximately 795800 A/m) was measured using a vibrating sample magnetometer (VSM). The result is also shown in Table 1.

TABLE 1

Component Materials, Molding Condition and Properties of Dust Core of Experiment 1.

| Component Materials of Dust Core | | | | | | Dust Core Properties | | |
|---|---|---|---|---|---|---|---|---|
| | | | Molding Temperature | | | | Radial | |
| Fe-based Amorphous Metal | Resin Binder | $T_m/T_x$ | T (K) | $T/T_x$ | Plastic Deformation | Filling Factor (%) | Crushing Strength K (MPa) | Flux Density $B_{100}$ (T) |
| Water-atomized Powder Having 2605HB1-like Composition ($T_x$ = 739K) | PEEK ($T_m$ = 613K) | 0.83 | 533 | 0.72 | Not Observed | 78.0 | 30 | 0.51 |
| | | | 553 | 0.75 | | 79.5 | 37 | 0.54 |
| | | | 573 | 0.78 | | 82.0 | 49 | 0.62 |
| | | | 593 | 0.80 | | 84.0 | 65 | 0.63 |
| | | | 613 | 0.83 | | 89.0 | 78 | 0.66 |
| | | | 633 | 0.86 | | 88.8 | 74 | 0.65 |
| | | | 653 | 0.88 | | 88.1 | 73 | 0.65 |
| | | | 673 | 0.91 | | 87.8 | 73 | 0.65 |
| | | | 693 | 0.94 | | 88.0 | 71 | 0.65 |

Figure 5:
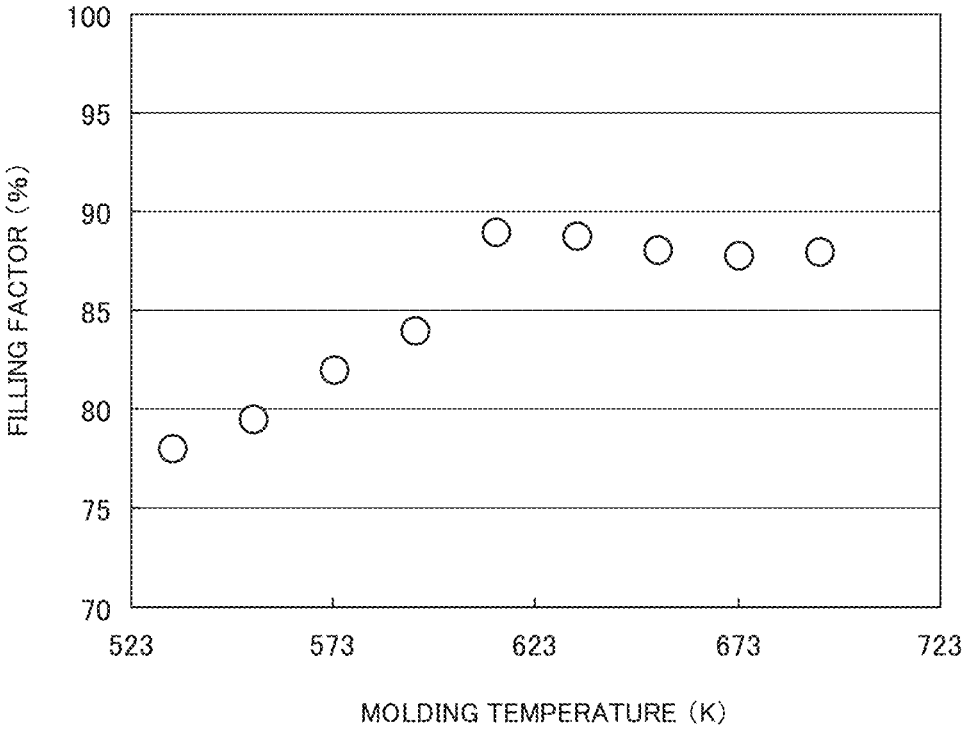
FIG. 5 is a graph showing a relationship between the molding temperatures and the filling factors of the Fe-based amorphous metals for the dust cores in Experiment 1.

FIG. 5 is a graph showing, for the dust cores in Experiment 1, a relationship between the molding temperatures and the filling factors of the Fe-based amorphous metals. As shown in FIG. 5 and Table 1, the filling factor increases with increasing the molding temperature. At molding temperatures of about 563 K or higher, the filling factors are at desirable levels (higher than 80%). At molding temperatures of about 603 K or higher, the filling factors are at more desirable levels (85% or higher). The filling factor is the highest at the melting point of PEEK (613 K). At molding temperatures from the melting point to 693 K, the filling factor is almost constant, although slightly decreasing with temperature.

The reference sample (a commercially available conventional amorphous metal dust core) has a filling factor of about 70%, a radial crushing strength of about 10 to 20 MPa, a flux density $B_{100}$ of about 0.4 T and an iron loss $W_{1/10k}$ (explained later) of about 100 kW/m$^3$.

In Table 1, all the dust core samples of Experiment 1 are made of a water atomized amorphous metal powder having a 2605HB1-like composition and a PEEK binder. Of these samples, a sample exhibiting a plastic deformation of the amorphous metal particles and having a filling factor higher than 80% is an invention example fabricated according to the invention. As shown in Table 1, such invention examples have a radial crushing strength about 2.5 times or more that of the commercially available reference sample and a flux density $B_{100}$ of about 1.5 times or more that of the reference sample. This result demonstrates that the properties of the invention's dust cores can be considerably improved compared to the conventional commercial dust core reference sample. By contrast, a sample that does not exhibit any plastic deformation of the amorphous metal particles is a comparative example not fabricated according to the invention. The properties of such comparative examples, although slightly improved, are not so much improved as expected.

Experiment 2

Fabrication of Dust Core

First, a water-atomized Fe—Si—B based amorphous metal powder (crystallization temperature $T_x$=739 K) having a composition similar to a 2605HB1 amorphous ribbon and the above-mentioned KUAMET® ($T_x$=813 K) were prepared. Each amorphous metal powder was sieved to obtain particles of 100 μm or smaller in size. Next, resin binders of PEEK (melting point T: =613 K), poly-phenylene sulfide (PPS, melting point $T_m$=613 K), and Polyamide 66 (PA66, melting point $T_m$=538 K) were prepared. Dust core samples were fabricated from various mixtures of these amorphous metal powders and resin binders using a method similar to that used in Experiment 1.

Mixtures containing the water-atomized Fe—Si—B based amorphous metal powder having a 2605HB1-like composition were warm molded at various temperatures from 613 to 693 K. These warm molded samples were then strain relaxation heat treated at 673 K in air for 1 hour. Likewise, mixtures containing the KUAMET® Fe-based amorphous metal powder were warm molded at various temperatures from 693 to 773 K, and these samples were strain relaxation heat treated at 698 K in air for 3 hours. The component materials, molding condition and properties of the dust cores of Experiment 2 are summarized in Table 2.

(Property Evaluation of Dust Core)

The thus fabricated dust cores of Experiment 2 were evaluated for the filling factor and mechanical strength using methods similar to those used in Experiment 1. The iron loss of the cores was also measured as another representative of the magnetic properties. Specifically, the iron loss $W_{1/10k}$ (unit: kW/m$^3$) in 0.1 T at 10 kHz was measured using a B-H analyzer (Iwatsu Test Instruments Corporation). The result is also shown in Table 2.

A dust core sample having a filling factor higher than 80%, a radial crushing strength greater than 20 MPa and an iron loss less than 100 kW/m$^3$ was overall rated as "Pass". The other samples that did not achieve all of these three performances were overall rated as "Fail". The result is also shown in Table 2.

TABLE 2

Component Materials, Molding Condition and Properties of Dust Core of Experiment 2.

| Component Materials of Dust Core | | | Molding Temperature | | Dust Core Properties | | | |
|---|---|---|---|---|---|---|---|---|
| Fe-based Amorphous Metal | Resin Binder | $T_m/T_x$ | T (K) | $T/T_x$ | Filling Factor (%) | Radial Crushing Strength K (MPa) | Iron Loss $W_{1/10k}$ (kW/m$^3$) | Overall Rating |
| Water-atomized Powder Having 2605HB1-like Composition ($T_x$ = 739K) | PEEK ($T_m$ = 613K) | 0.83 | 613 | 0.83 | 89.0 | 78 | 46 | Pass |
| | | | 633 | 0.86 | 88.8 | 74 | 45 | |
| | | | 653 | 0.88 | 88.1 | 73 | 45 | |
| | | | 673 | 0.91 | 87.8 | 73 | 42 | |
| | | | 693 | 0.94 | 88.0 | 71 | 43 | |
| | PPS ($T_m$ = 563K) | 0.76 | 613 | 0.83 | 87.5 | 52 | 44 | Pass |
| | | | 633 | 0.86 | 87.1 | 45 | 42 | |
| | | | 653 | 0.88 | 86.4 | 43 | 40 | |
| | | | 673 | 0.91 | 86.2 | 42 | 40 | |
| | | | 693 | 0.94 | 86.0 | 41 | 39 | |
| | PA66 ($T_m$ = 538K) | 0.73 | 613 | 0.83 | 87.1 | 35 | 42 | Pass |
| | | | 633 | 0.86 | 87.0 | 35 | 41 | |
| | | | 653 | 0.88 | 86.0 | 34 | 58 | |
| | | | 673 | 0.91 | 85.5 | 33 | 68 | |
| | | | 693 | 0.94 | 85.4 | 32 | 70 | |
| KUAMET ® ($T_x$ = 813K) | PEEK ($T_m$ = 613K) | 0.75 | 693 | 0.85 | 89.5 | 52 | 59 | Pass |
| | | | 713 | 0.88 | 89.0 | 51 | 56 | |
| | | | 733 | 0.90 | 88.8 | 50 | 54 | |
| | | | 753 | 0.93 | 88.5 | 49 | 53 | |
| | | | 773 | 0.95 | 88.4 | 21 | 86 | |
| | PPS ($T_m$ = 563K) | 0.69 | 693 | 0.85 | 82.5 | 19 | 80 | Fail |
| | | | 713 | 0.88 | 82.9 | 19 | 86 | |
| | | | 733 | 0.90 | 83.8 | 15 | 86 | |
| | | | 753 | 0.93 | 84.0 | 10 | 87 | |
| | | | 773 | 0.95 | 84.5 | 9 | 88 | |

TABLE 2-continued

Component Materials, Molding Condition and Properties of Dust Core of Experiment 2.

| Component Materials of Dust Core | | | | | Dust Core Properties | | | |
|---|---|---|---|---|---|---|---|---|
| Fe-based Amorphous Metal | Resin Binder | $T_m/T_x$ | Molding Temperature T (K) | $T/T_x$ | Filling Factor (%) | Radial Crushing Strength K (MPa) | Iron Loss $W_{1/10k}$ (kW/m$^3$) | Overall Rating |
| | PA66 ($T_m$ = 538K) | 0.66 | 693 | 0.85 | 82.6 | 10 | 105 | Fail |
| | | | 713 | 0.88 | 82.9 | 9 | 108 | |
| | | | 733 | 0.90 | 83.7 | 6 | 111 | |
| | | | 753 | 0.93 | 84.1 | 6 | 115 | |
| | | | 773 | 0.95 | 84.0 | 6 | 120 | |

As shown in Table 2, because all the dust core samples of Experiment 2 are formed by warm molding at $T/T_x \geq 0.75$, they all have a filling factor higher than 80%. When the components of a dust core sample satisfies the invention's specification of "$T_m/T_x \geq 0.70$", the Fe-based amorphous metal particles are plastically deformed without thermally degrading the resin binder. Such dust core samples have better magnetic properties and a higher mechanical strength than the conventional commercial dust core reference sample, and thus are invention examples having an overall rating of "Pass". In contrast, when the components of a dust core sample do not satisfy the invention's specification of "$T_m/T_x \geq 0.70$", the resin binder of the dust core sample is at least partially thermally degraded. As a result, the magnetic properties and mechanical strength of such samples are inferior to those of the conventional commercial dust core reference sample; thus, these samples are comparative examples having an overall rating of "Fail".

In Table 2, note the samples that use the KUAMET® Fe-based amorphous metal powder are warm molded at 773 K. The T/T, values of these samples are approximately equal to 0.95 (because $T/T_x$=773/813=0.950 . . . , which becomes 0.95 by rounding off the third decimal place to the nearest second decimal place). The thermal expansion coefficients of the resin binders used are about one order of magnitude greater than that of the Fe-based amorphous metals used, and therefore there is a tendency of the filling factor to decrease with the molding temperature.

More specifically, when the water-atomized Fe based amorphous metal powder having a 2605HB1-like composition is used combined with any one of the resin binders, the resulting dust core has better magnetic properties and a higher mechanical strength than commercially available dust core reference sample.

When the KUAMET® Fe-based amorphous metal powder is used with the PEEK resin binder, the resulting dust core has better magnetic properties and a higher mechanical strength than the commercially available dust core reference sample. This is probably because of the high thermal resistance of PEEK, which has a thermal decomposition temperature of 773 K. However, when a mixture powder of KUAMET® and PEEK is warm molded at 773 K, the resulting dust core has a lower radial crushing strength and a greater iron loss than the other KUAMET®/PEEK dust core samples molded at lower temperatures. This is probably because 773 K is near the thermal decomposition temperature of PEEK.

By contrast, when the KUAMET® Fe-based amorphous metal powder is used with the PPS resin binder or the PA66 resin binder, the magnetic properties and/or mechanical strength of the resulting dust core are comparable or inferior to those of the commercially available dust core reference sample. This is probably because these resin binders are thermally degraded (note that PPS and PA66 are less thermally resistant than PEEK). However, these KUAMET®/PPS and KUAMET®/PA66 dust core samples have a tendency of the filling factor to increase with the molding temperature. This is probably because of a volume reduction of the resin binder caused by the thermal decomposition of the binder.

Experiment 3

Fabrication of Dust Core

First, 75 mass % of a milled powder (average particle size=100 μm) of a 2605HB1 Fe-based amorphous metal ribbon and 25 mass % of μW2-08 (Epson Atmix Corporation, crystallization temperature $T_x$=813 K, average particle size=6 μm) were mixed in such a manner that the mixture powder had a bimodal particle size distribution having two peaks. Next, a resin binder of PEEK was added to this Fe-based amorphous metal mixture powder in such a way that the binder had various volume percentages (0.5 to 16 volume %). Here, there were prepared various samples having different volume percentages of the PEEK binder (0.5 to 16 volume %). Then, the mixture of the Fe-based amorphous metal mixture powder and the PEEK binder were warm molded at 673 K. Various dust core samples were fabricated from these different mixtures using a method similar to that used in Experiment 1.

Herein, in the present invention, the following should be noted: The milled powder of 2605HB1 is obtained by milling a 25 μm thick 2605HB1 amorphous ribbon. The average powder size of the milled 2605HB1 powder is the average longest dimension of the milled powder particles determined by observation under an electron microscope. Herein, the crystallization temperature $T_x$ of a mixture of several different amorphous metal powders is defined as the lowest of the crystallization temperatures of the amorphous metal powders. Likewise, the melting point $T_m$ of a mixture of several different resin binders is defined as the lowest of the melting points of the resin binders.

According to this definition, the $T_m/T_x$=0.83 and the $T/T_x$=0.91 in Experiment 3. The component materials and properties of the thus fabricated dust cores are shown in Table 3.

(Property Evaluation of Dust Core)

The thus fabricated dust core samples of Experiment 3 were evaluated for the filling factor, mechanical strength and magnetic properties using methods similar to those used in Experiment 1. The flux density and iron loss were measured as representatives of the magnetic properties in Experiment 3. The result is also shown in Table 3.

TABLE 3

Component Materials and Properties of Dust Core of Experiment 3.

| Component Materials of Dust Core | | | | Dust Core Properties | | | |
|---|---|---|---|---|---|---|---|
| Fe-based Amorphous Metal | Resin Binder Material | Resin Binder Filling Factor (%) | Plastic Deformation | Filling Factor (%) | Radial Crushing Strength K (MPa) | Flux Density (T) | Iron Loss $W_{1/10k}$ (kW/m$^3$) |
| Milled Powder of 2605HB1 (75 mass %) + AW2-08 (25 mass %) | PEEK | 0.5 | Observed | 92.2 | 98 | 0.69 | 151 |
| | | 1 | | 91.4 | 75 | 0.67 | 50 |
| | | 5 | | 90.4 | 73 | 0.67 | 49 |
| | | 10 | | 89.0 | 74 | 0.67 | 42 |
| | | 12 | | 87.2 | 72 | 0.62 | 41 |
| | | 14 | | 85.8 | 72 | 0.60 | 40 |
| | | 16 | Not Observed | 79.0 | 73 | 0.45 | 39 |

As described above, in Experiment 3, a mixture powder of two types of amorphous metal powders having different particle sizes are mixed with 1 to 14 volume % of a resin binder. As shown in Table 3, the resulting dust cores molded from these mixtures having different resin binder volume percentages exhibit a higher filling factor than the Experiment 1 dust core sample molded at 673 K. Thus, these samples are invention examples achieving the invention's target performance. The above result demonstrates that when a mixture powder containing several types of amorphous metal powders having different crystallization temperatures is molded (pressed), an amorphous metal of a type having the lowest crystallization temperature is plastically deformed by the molding and thereby the resulting dust core can be densified.

However, when the volume percentage of PEEK is 16 volume %, the resulting dust core, although having a low iron loss, has a low filling factor (80% or less) and as a result has a significantly low flux density. Thus, this sample is a comparative example that does not achieve the invention's target performance. When the volume percentage of PEEK is 0.5 volume %, the resulting dust core has a considerably high iron loss, although having a high filling factor, a high radial crushing strength and a high flux density. Thus, this sample is, too, a comparative example that cannot achieve the invention's target performance. This is probably because the amount of the resin binder is too small to sufficiently achieve electrical insulation among the amorphous metal particles, thereby increasing eddy current loss.

Experiment 4

In this experiment, some dust cores after warm-molding were subjected to a strain relaxation heat treatment by microwave heating, and the result was evaluated. Each dust core was heated in a magnetic field using a 2.45 GHz single mode microwave furnace. The initial input power of the microwave was 0.7 kW. A dust core molded from a water-atomized amorphous metal powder having a 2605HB1-like composition was heated to a target temperature of 673 K; a dust core molded from KUAMET® was heated to a target temperature of 698 K. After each target temperature was reached, this temperature was maintained for 20 min. The temperature measurement was conducted using a radiation thermometer (CHINO Corporation IR-CAI).

The result was that it was possible to rapidly heat each dust core at a rate of 20 to 30° C./s from soon after the start of the microwave radiation. Also, this strain relaxation microwave heat treatment for only 20 minutes was able to reduce the iron loss of each dust core to a level comparable to those obtained by strain relaxation radiation heat treatments for 1 to 3 hr. Thus, the microwave heat treatment can reduce the treatment time to ⅓ or less of those of conventional radiation heat treatments.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A dust core, comprising a mixture powder compacted, the mixture powder including:

an Fe-based amorphous metal powder having a crystallization temperature $T_x$ (unit: K), the Fe-based amorphous metal powder being plastically deformed, the plastically deformed Fe-based amorphous metal powder having a filling factor in the dust core higher than 80% and not higher than 99%; and a resin binder having a melting point $T_m$ (unit: K), wherein the $T_x$ and $T_m$ satisfy a relationship of "$T_m/T_x \geq 0.70$".

2. The dust core according to claim 1, wherein the crystallization temperature $T_x$ of the Fe-based amorphous metal powder is 823 K or lower, and the melting point $T_m$ of the resin binder is 533 K or higher.

3. The dust core according to claim 1, wherein the Fe-based amorphous metal powder is a powder of an Fe—Si—B based amorphous metal, and the resin binder is one of polyether ether ketone, poly-phenylene sulfide and Polyamide 66.

4. An inductance element including a dust core, wherein at least one part of the dust core is the dust core according to claim 1.

5. The inductance element according to claim 4, wherein the inductance element is an electric reactor or a choke coil.

6. A rotary electric machine including a dust core, wherein at least one part of the dust core is the dust core according to claim 1.

7. The rotary electric machine according to claim 6, wherein the dust core is a stator core and/or a rotor core.

* * * * *